US006217088B1

(12) United States Patent
Magnusson

(10) Patent No.: US 6,217,088 B1
(45) Date of Patent: Apr. 17, 2001

(54) FOLLOWER ARRANGEMENT FOR A LOCK

(76) Inventor: Claes Magnusson, 23 McKay Road, Wimbledon, SW20 OHT, London (GB)

( * ) Notice: Subject to any disclaimer, the term of this patent is extended or adjusted under 35 U.S.C. 154(b) by 0 days.

(21) Appl. No.: 09/369,861

(22) Filed: Aug. 9, 1999

(51) Int. Cl.[7] ..... E05C 1/12
(52) U.S. Cl. ..... 292/165; 292/DIG. 52
(58) Field of Search ..... 292/165, 169, 292/169.16, 169.21, 169.22, 169.23, 348, 349, 358, 359, DIG. 52

(56) References Cited

U.S. PATENT DOCUMENTS

| | | | | |
|---|---|---|---|---|
| 294,881 | * | 3/1884 | Jones | 292/348 |
| 537,092 | * | 4/1895 | White | 292/348 |
| 692,265 | * | 2/1902 | Glover | 292/348 |
| 814,186 | * | 3/1906 | Christensen | 292/169.21 |
| 1,502,022 | * | 7/1924 | Dexter | 292/169.23 |
| 1,553,186 | * | 9/1925 | Rumberg | 292/347 |
| 1,559,037 | * | 10/1925 | Floyd | 292/169.16 |
| 1,619,789 | * | 3/1927 | Vogt | 292/169.21 |
| 1,895,893 | | 1/1933 | Moore . | |
| 2,370,691 | * | 3/1945 | Schlage | 292/37 |
| 2,519,808 | * | 8/1950 | Young | 70/151 R |
| 2,715,036 | | 8/1955 | Miller . | |
| 3,020,073 | | 2/1962 | Williams . | |
| 5,620,211 | * | 4/1997 | Ellis | 292/1.5 |

FOREIGN PATENT DOCUMENTS

| | | |
|---|---|---|
| 1553526 | 1/1971 | (DE) . |
| 2809546 A1 | 9/1978 | (DE) . |

* cited by examiner

*Primary Examiner*—Gary W. Estremsky
(74) *Attorney, Agent, or Firm*—Birch, Stewart, Kolasch & Birch, LLP

(57) ABSTRACT

A follower arrangement for a lock having two equally shaped followers rotatable a limited angle by a common shaft operable by at least one handle to retract a latch bolt of the lock. Each follower has one wing portion having an operative abutment surface. The operative abutment surface of the followers are located on opposite sides of the shaft, such that the operative abutment surface of a first follower contacts a shoulder of a first leg of the latch bolt directed in a first direction, and such that the operative abutment surface of a second follower contacts a shoulder of a second leg of the latch bolt directed in a second direction opposite to said first direction.

12 Claims, 2 Drawing Sheets

FIG. 4
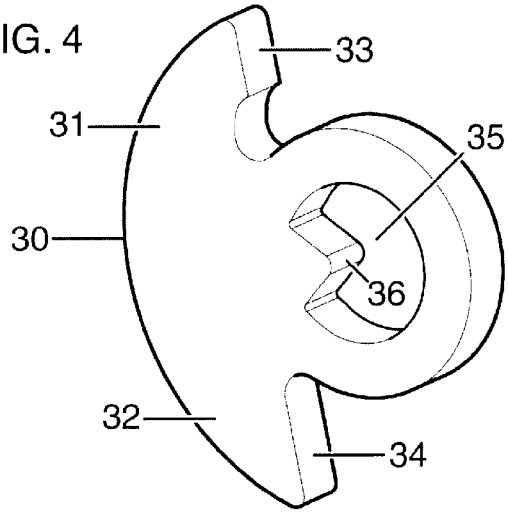
FIG. 5
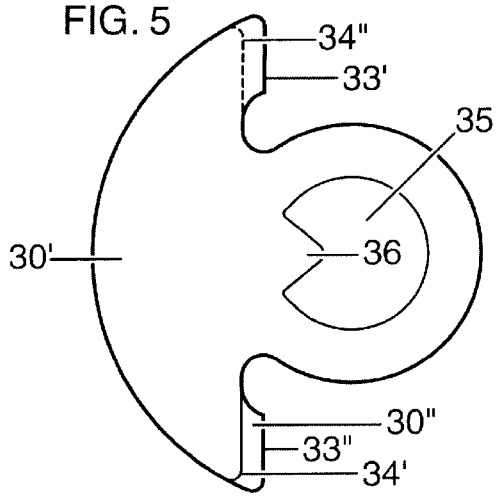
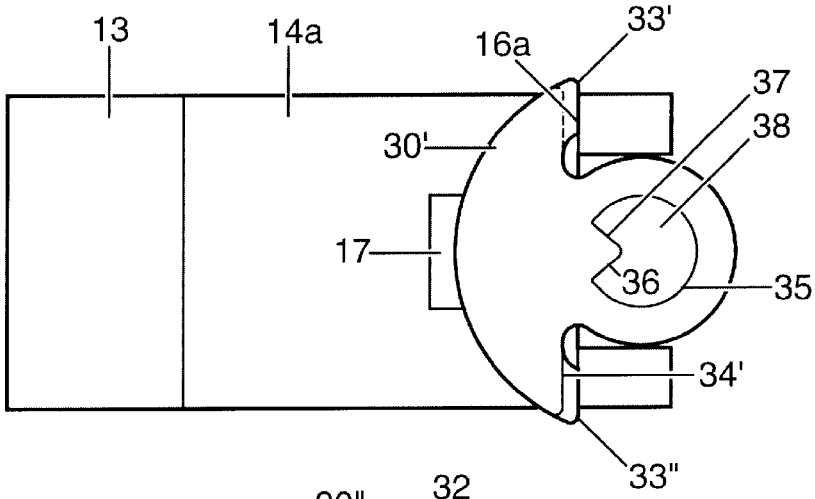
FIG. 6
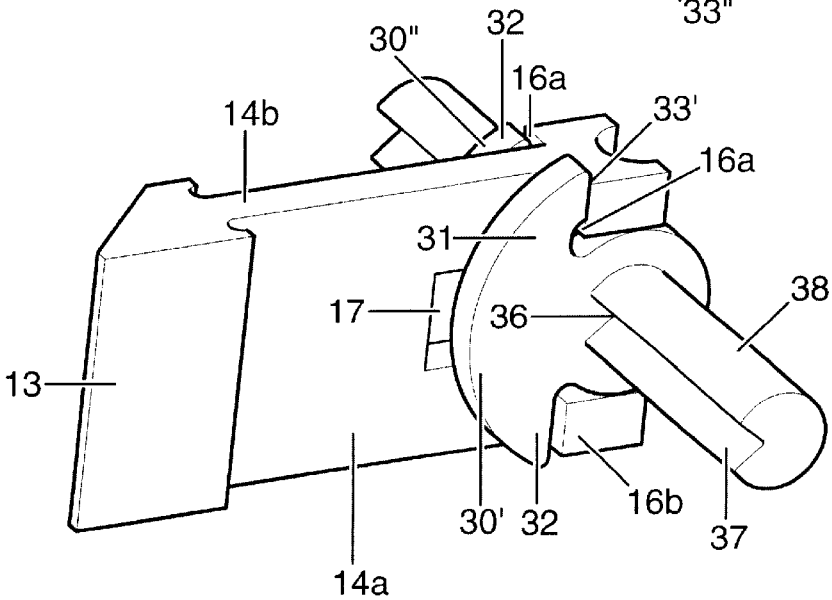
FIG. 7

FOLLOWER ARRANGEMENT FOR A LOCK

FIELD OF THE INVENTION

The present invention concerns a follower arrangement for a lock.

More precisely the invention concerns a follower arrangement, where two equally shaped followers are rotatable a limited angle by a common shaft operable by at least one handle to retract a latch bolt of the lock. In one known such arrangement (FIGS. 1 and 2), the latch bolt is partly divided in two spaced legs straddling the shaft, each leg having two shoulders protruding in opposite directions. One follower is located on each side of the latch bolt and each follower has two wing-like protrusions having abutment surfaces located at equal distances from the axis of the shaft and in a common plane parallel to the axis of the shaft, but generally offset therefrom. The abutment surfaces of each follower cooperate with one shoulder of each leg protruding in the same direction, such that upon rotation of the shaft in a first direction, a first wing of each follower engages a first pair of opposed shoulders, and upon rotation of the shaft in a second direction, a second wing of each follower engages a second pair of opposed shoulders.

Since the latch bolt is urged by a spring force towards its locking position, the handle connected to the shaft is kept in its neutral, substantially horizontal position by this spring force. In the normal mounting position of a lock in, e.g., a door leaf, the lock is vertically oriented, i.e., its latch bolt is horizontally movable and its shaft is rotatable about a horizontal axis. The shaft normally has a square cross section (or any other cross section suited for positive transfer of momentum from a shaft to a follower) and projects through correspondingly formed apertures in the followers. Normal tolerances of manufacture result in a certain play between the shaft and the followers, meaning that a handle attached to the shaft may occupy a more downwardly inclined position than the intended horizontal position. Although this does not really affect the locking properties of the lock, it may give an impression of inferior quality.

OBJECT OF THE INVENTION

It is the object of the invention, thus, to provide a follower arrangement of the kind stated, which does not suffer from the drawback mentioned, i.e., that does effectively eliminate play between the handle shaft and the followers such that the handle will occupy a substantially horizontal position.

SUMMARY OF THE INVENTION

According to the present invention, the main object stated has been achieved in that each follower has but one wing having an operative abutment surface, and that the operative abutment surfaces of the two followers are located on opposite sides of the shaft, such that the operative abutment surface of one follower contacts a shoulder of one leg of the latch bolt directed in one direction and the operative abutment surface of the other follower contacts a shoulder of the other leg directed in the opposite direction.

BRIEF DESCRIPTION OF THE DRAWINGS

An embodiment of the present invention will now be described, reference being made to the annexed drawings, wherein:

FIG. 4 is a perspective view of a single follower according to the present invention;

FIG. 5 is a side view of two followers according to FIG. 4;

FIG. 6 is a side view of the arrangement of FIG. 7; and

FIG. 7 is a perspective view of a latch bolt, two followers and a shaft.

DETAILED DESCRIPTION OF A PREFERRED EMBODIMENT

Figure 1:
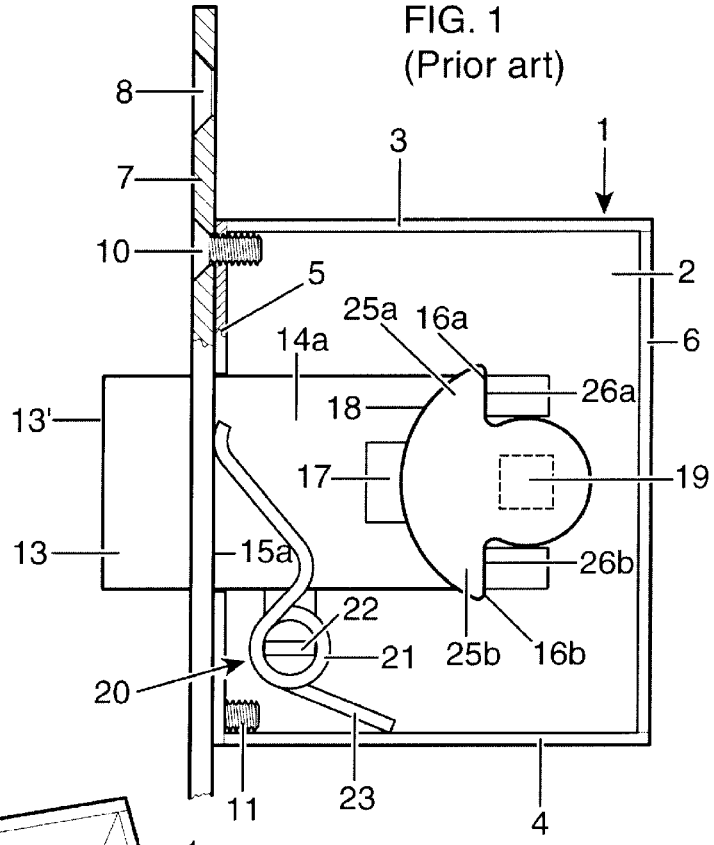
FIG. 1 (Prior art)
FIG. 1 is a side view of a lock according to the state of having its case opened so as to make visible a latch bolt and one follower.
Figure 2:
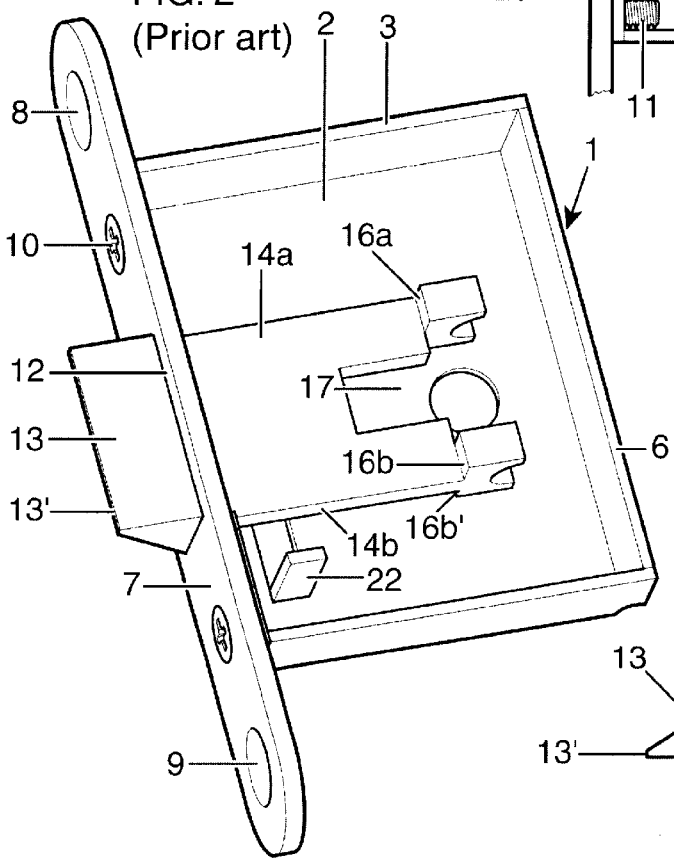
FIG. 2 (Prior art)
FIG. 2 is perspective side view of the lock according to FIG. 1 having both followers and the helical spring removed.
Figure 3:
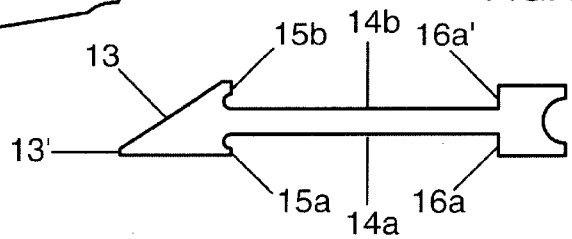
FIG. 3 is a top view of the latch bolt used in the lock according to FIGS. 1 and 2 as well as in a lock using the follower arrangement according to the present invention.

For facilitated understanding of the present invention, reference is first made to the conventional follower arrangement utilized in the lock of FIGS. 1 and 2. The lock case 1 of this lock is shown having one side wall removed and having a further side wall 2, an upper wall 3, a lower wall 4, a front wall 5 and a back wall 6. A forend 7 has holes 8 and 9 for attachment of the lock to, e.g., a door leaf. Screws 10, 11 attach the forend to the front wall 5. The forend also has a rectangular opening 12 through which a latch bolt 13 is slidable between a foremost, locking position, in which it projects from the case as shown, and a non-shown, unlocking position, in which it is backwardly retracted to within the case so as to leave its front edge 13' substantially flush with the forend 7. The latch bolt has on each side a recessed portion 14*a*, 14*b* forwardly defined by a shoulder 15*a*, 15*b*, respectively. In the backward direction a corresponding shoulder is divided in two shoulders 16*a*, 16*b* on one side and 16*a'*, 16*b'* on the opposite side separated by a slot 17 extending from the backward end of the latch bolt about half way to its forward end.

The latch bolt is operable by means of two equally shaped followers 18, only one being shown in FIG. 1. The followers have square holes 19 intended for insertion therein of a square rod connected to a handle for rotating the follower through a limited angle. A helical spring 20 having its coil 21 positioned about a lug 22 bent in from the side wall 2 has one end 23 bearing on the inner side of the lower wall 4 and one end 24 bearing on the shoulder 15 of the latch bolt, so as to urge the latter towards its locking position. The followers are of the kind having two equal wings 25*a*, 25*b* extending in opposite directions and having aligned abutment surfaces 26*a*, 26*b* contacting a respective one of the shoulders 16*a*, 16*b*. This arrangement is particularly intended for the case where it is desired that the latch bolt shall be operable by a handle in both rotational directions of the followers against counteracting forces of the spring 20, i.e., upon pressing as well as raising the handle.

When the lock is vertically mounted it is presumed that the grip portion of its handle shall be directed substantially horizontally, i.e., to the right in FIG. 1. However, due to inevitable tolerances in the manufacture of the shaft as well as of the holes of the followers, the grip portion will sag a bit until proper engagement has been established between the shaft and the square hole of the followers. Then, the handle will exert a clockwise momentum on both followers possibly leading to some further sagging until the spring load of the spring leg 24 becomes effective.

In order to set aside these problems, the present invention provides the new follower arrangement particularly shown in FIGS. 4–7.

As seen in FIG. 4, a follower 30 according to the present invention has two wings 31, 32 having surfaces 33, 34, respectively. In contrast to the conventional follower, however, these surfaces are located in different planes, i.e., planes located at different distances from the shaft axis as best seen in FIG. 5. Consequently, only the surface 33 located in a plane closest to the shaft axis provides an abutment surface and will contact a shoulder of the latch bolt. According to the present invention, the two followers 30', 30" are mounted on the shaft such that one has its abutment surface 33' contacting a shoulder 16*a* (upper shoulder in FIGS. 6 and 7) on one side of the latch bolt and such that the other has its abutment surface 33" contacting a shoulder 16*b'* (lower invisible shoulder in FIGS. 6 and 7).

Since the latch bolt is constantly urged towards its locking position, this arrangement will cause the shoulders to impart counter-directed rotational forces to the two followers resulting in possible play between the shaft and the followers being eliminated.

As seen in FIGS. 4 and 5, as an alternative to a more normal, square hole, shaft hole 35 is circular having an inwardly directed protrusion 36 cooperating with a correspondingly shaped groove 37 in a cylindrical shaft 38.

The followers here described have two wings 31, 32, only one wing 31 of which being operative as regards eliminating play between the followers and the shaft. Evidently, thus, followers having but one wing would be useful to fulfill the object of the invention to eliminate play between the shaft and the holes of the followers. However, it is preferred to maintain the substantially half circular main portion of the follower body, since it has proven useful when mounting the lock, particularly to keep the followers in place at times the handle shaft 38 is withdrawn when mounting and dismounting of the lock in, e.g., a door leaf.

What is claimed is:

1. A follower arrangement for a lock having two equally shaped followers individually rotatable a limited angle by a common shaft operable by at least one handle to retract a latch bolt from an advanced rest position, said latch bolt having two legs straddling said shaft, each leg having at least one shoulder extending therefrom in an axial direction of said shaft, each follower includes two wing portions one of which includes an operative abutment surface and the other of which includes an offset surface, said operative abutment surface of a first of said followers contacting a shoulder of a first of said legs in a rest position and said operative abutment surface of a second of said followers simultaneously contacting a shoulder of a second of said legs in the rest position;

wherein said operative abutment surface of each follower is arranged on a first plane and said offset surface of each follower is arranged on a second plane, said first plane being arranged at a first predetermined distance relative to said common shaft and said second plane being arranged at a second predetermined distance relative to said common shaft, said first predetermined distance being distinct relative to said second predetermined distance.

2. The follower arrangement according to claim 1, wherein said shaft has a first circular cross section and a groove extending in a longitudinal direction of said shaft, and wherein each of said followers has a hole of a circular cross section corresponding to said first cross section, said hole having a protrusion mating said groove.

3. The follower arrangement according to claim 1, wherein said operative abutment surface of said first follower and said operative abutment surface of said second follower impart a counter-directed rotational force on said followers for eliminating play between the shaft and the followers.

4. The follower arrangement according to claim 1, wherein each follower includes a substantially circular portion with said two wings projecting outwardly therefrom, said substantially circular portion including an aperture for securing each of said follower to said common shaft.

5. The follower arrangement according to claim 4, wherein said aperture is a hole with a protrusion projecting therein, said protrusion mating with a groove on said common shaft for fixing the orientation of each of said followers relative to said common shaft.

6. The follower arrangement according to claim 1, wherein said plane of said operative abutment surface is located closer to the common shaft relative to the offset surface.

7. A follower arrangement for a lock having two equally shaped followers individually rotatable a limited angle by a common shaft operable by at least one handle to retract a latch bolt from an advanced rest position, said latch bolt having two legs straddling said shaft, each leg having at least one shoulder extending therefrom in an axial direction of said shaft, each follower includes two wing portions one of which includes an operative abutment surface and the other of which includes an offset surface, said operative abutment surface of a first of said followers contacting a shoulder of a first of said legs in a rest position and said operative abutment surface of a second of said followers simultaneously contacting a shoulder of a second of said legs in the rest position wherein a plane of said operative abutment surface is located closer to the common shaft relative to the offset surface.

8. The follower arrangement according to claim 7, wherein said shaft has a first circular cross section and a groove extending in a longitudinal direction of said shaft, and wherein each of said followers has a hole of a circular cross section corresponding to said first cross section, said hole having a protrusion mating said groove.

9. The follower arrangement according to claim 7, wherein said operative abutment surface of each follower is arranged on a first plane and said offset surface of each follower is arranged on a second plane, said first plane being arranged at a first predetermined distance relative to said common shaft and said second plane being arranged at a second predetermiined distance relative to said common shaft, said first predetermined distance being distinct relative to said second predetermined distance.

10. The follower arrangement according to claim 7, wherein said operative abutment surface of said first follower and said operative abutment surface of said second follower impart a counter-directed rotational force on said followers for eliminating play between the shaft and the followers.

11. The follower arrangement according to claim 7, wherein each follower includes a substantially circular portion with said two wings projecting outwardly therefrom, said substantially circular portion including an aperture for securing each of said follower to said common shaft.

12. The follower arrangement according to claim 11, wherein said aperture is a hole with a protrusion projecting therein, said protrusion mating with a groove on said common shaft for fixing the orientation of each of said followers relative to said common shaft.

* * * * *